US006073637A

United States Patent [19]

Hayward et al.

[11] Patent Number: 6,073,637

[45] Date of Patent: Jun. 13, 2000

[54] CLEANING METHOD AND APPARATUS

[75] Inventors: John Hayward, West Sussex; Gordon Winson, Berkshire, both of United Kingdom; Aage Raatrae, Bergen, Norway

[73] Assignee: Speciality Chemical Holdings Limited, Middlesex, United Kingdom

[21] Appl. No.: 09/237,622

[22] Filed: Jan. 26, 1999

[30] Foreign Application Priority Data

Jan. 30, 1998 [GB] United Kingdom ..... 9802079

[51] Int. Cl.[7] ..... B08B 3/02; B08B 9/00

[52] U.S. Cl. ..... 134/22.1; 134/22.12; 134/22.18; 134/23; 134/32; 134/198

[58] Field of Search ..... 134/22.1, 22.12, 134/22.18, 23, 24, 26, 32, 34, 166 C, 168 C, 169 C, 198; 415/121.3, 116

[56] References Cited

U.S. PATENT DOCUMENTS

| | | | |
|---|---|---|---|
| 4,196,020 | 4/1980 | Hornak et al. | 134/167 R |
| 4,787,404 | 11/1988 | Klosterman et al. | 134/198 |
| 5,011,540 | 4/1991 | McDermontt | 134/23 |
| 5,193,976 | 3/1993 | Kolev et al. | 415/116 |
| 5,273,395 | 12/1993 | McDermott | 134/199 |
| 5,618,353 | 4/1997 | Irvine et al. | 134/22.17 |
| 5,868,860 | 2/1999 | Asplund | 134/22.1 |

FOREIGN PATENT DOCUMENTS

| | | |
|---|---|---|
| 2 290 829 | 1/1996 | United Kingdom . |
| WO 96/40453 | 12/1996 | WIPO . |

*Primary Examiner*—Randy Gulakowski
*Assistant Examiner*—Saeed Chaudhry
*Attorney, Agent, or Firm*—Flynn, Thiel, Boutell & Tanis, P.C.

[57] ABSTRACT

A method of a gas turbine compressor (1) in which droplets of a cleaning fluid are sprayed into the compressor, comprising the steps of: spraying droplets of a substantially first uniform size into or onto the fluid path for a first period; and then spraying droplets of a substantially second uniform size into or onto the fluid path for a second period, wherein the first and second uniform droplet sizes are different.

5 Claims, 9 Drawing Sheets

CLEANING METHOD AND APPARATUS

The present invention relates to method and apparatus for cleaning a bounded passage defining a gas path through a device. The invention is particularly suitable for cleaning the inside (including blades and rotor) of devices such as turbine compressors through which pass large quantities of air. Air carries contaminants and these stick to and dirty the compressor blades thereby reducing a compressor's efficiency.

A known method of attempting to remove atmospheric contaminants from the internal surfaces of compressors whilst they are running has been to inject large volumes of water, or water and detergent mixes at constant pressure into the compressor via spray nozzles. The fluid leaves the nozzle as droplets that vary in volume according to the pressure of the fluid supplied to the nozzle and the characteristics of the nozzle.

This method relies on the impact energy of the droplets (as well as any chemical effect produced by the cleaning fluid) to clean the dirty surfaces struck by cleaning fluid droplets. However, of the droplets produced by the spray nozzles most are either too large and therefore have a tendency to be spun out to the compressor walls by centrifugal forces acting upon them, or too small and therefore without sufficient energy to penetrate pressured surfaces. This means that only a small proportion of the cleaning fluid passes down the centre of the compressor space where the compressor blades are located. The small proportion of this fluid passing down the middle of the compressor in the known cleaning method leaves significant areas at the roots of the compressor blades untreated.

On the other hand, droplets that are sized so as not to be affected by centrifugal forces are subjected to evaporation and reduced in volume to the point that they no longer have sufficient mass to enable them to penetrate the boundary layer surrounding the compressor blades and impact the compressor blades. This boundary layer is caused by the air flow over the surfaces of the blades. Therefore, in this known method, little or no cleaning fluid reaches the latter stages of the compressor.

This known cleaning method is particularly ineffective for the roots of compressor blades towards the rear of a compressor. The larger droplets have been spun outwards, and the smaller droplets largely evaporated, when the cleaning fluid reaches the rear of a compressor.

The spinning outwards of large droplets, and inability of smaller droplets to penetrate the compressor blade boundary layer, means that such cleaning systems waste large volumes of the cleaning agent and water; the too large and too small droplets not contacting compressor blades and therefore not having a cleaning action thereon.

Attempts to improve the efficiency of such injection systems have previously focussed on reducing the amount of wasted cleaning fluid by selecting a single desired droplet size which has been calculated as the optimum size for the compressor being cleaned. Droplets are formed which are of a more uniform size which are considered optimum for the cleaning of a particular compressor. Such systems are essentially enhanced versions of the previously described cleaning system. Although this optimisation, combined with high flow rates, ensures a more uniform wetting of the compressor blade surfaces and results in operators being able to maintain compressor cleanliness with relatively small volumes of fluid, this enhanced system does not solve the problem of effectively cleaning the rear of the compressor.

As discussed above, a significant problem associated with the known compressor cleaning systems is their inability to effectively clean the rear of a compressor or similar. In addition to the spinning outwards and evaporation of droplets, the known systems also remove deposits from the early stages of a compressor but allow them to reform in the latter stages with the inherent risk of corrosion and compressor stall. This problem is particularly relevant for so-called "on-line" cleaning systems which wash/clean whilst the engine or device (e.g. compressor) is running at operating speeds and temperatures.

The inventors of the present invention have appreciated that the inefficiency of the known cleaning systems arises from the very different environmental conditions pertaining at different points in the device (e.g. turbine compressor) being cleaned. The inventors are also the first to appreciate that these differences mean that there is no single optimum droplet size for cleaning a compressor or similar device defining a gas path.

A typical industrial gas turbine compressor consists of 12 stages each of which has different temperature and pressure conditions (see FIG. 1). The temperature and pressure of the incoming air at the first stage will typically be ambient values and will typically increase by 25° C. and 1 bar pressure per stage. The exit temperature and pressure will therefore typically be of the order of 300° C. at 12 bar. Taking the effect of pressure on the temperature into account, the effective temperature at the exit is in the region of 160° C.

Droplets of cleaning liquid that are sprayed into the compressor will be subjected to the same increments of temperature and pressure as the incoming air, so they will reduce in volume as they move through the compressor.

If the optimum droplet size for cleaning using a particular compressor cleaning fluid (for example, that available under the trade mark R-MC) is calculated to be 200 microns, then droplets of this original size will have reduced in volume by 80% by time they reach the last compressor stage of a 12 stage compressor such as that shown in FIG. 1. This droplet will be too small to penetrate the boundary layer of air flowing over the blade surface, and so no cleaning will take place.

If the droplet size was generally increased to account for evaporation losses then the first stages of the compressor would not be cleaned effectively as the droplets would be too large for this portion of the compressor.

The inventors are the first to recognise that the inefficiency of the known cleaning methods arises from the different environmental conditions pertaining at different parts of the gas path, and consequently the existence of different optimum droplet sizes for different parts of the gas path through, for example, a compressor.

The present invention, as defined in the independent claims to which reference should now be made, provides a cleaning method and cleaning apparatus which cleans passages defining gas paths through devices such as compressors, far more effectively than the previously known systems.

Preferred embodiments of the invention will now be described by reference to the accompanying figures, in which.

Figure 1:
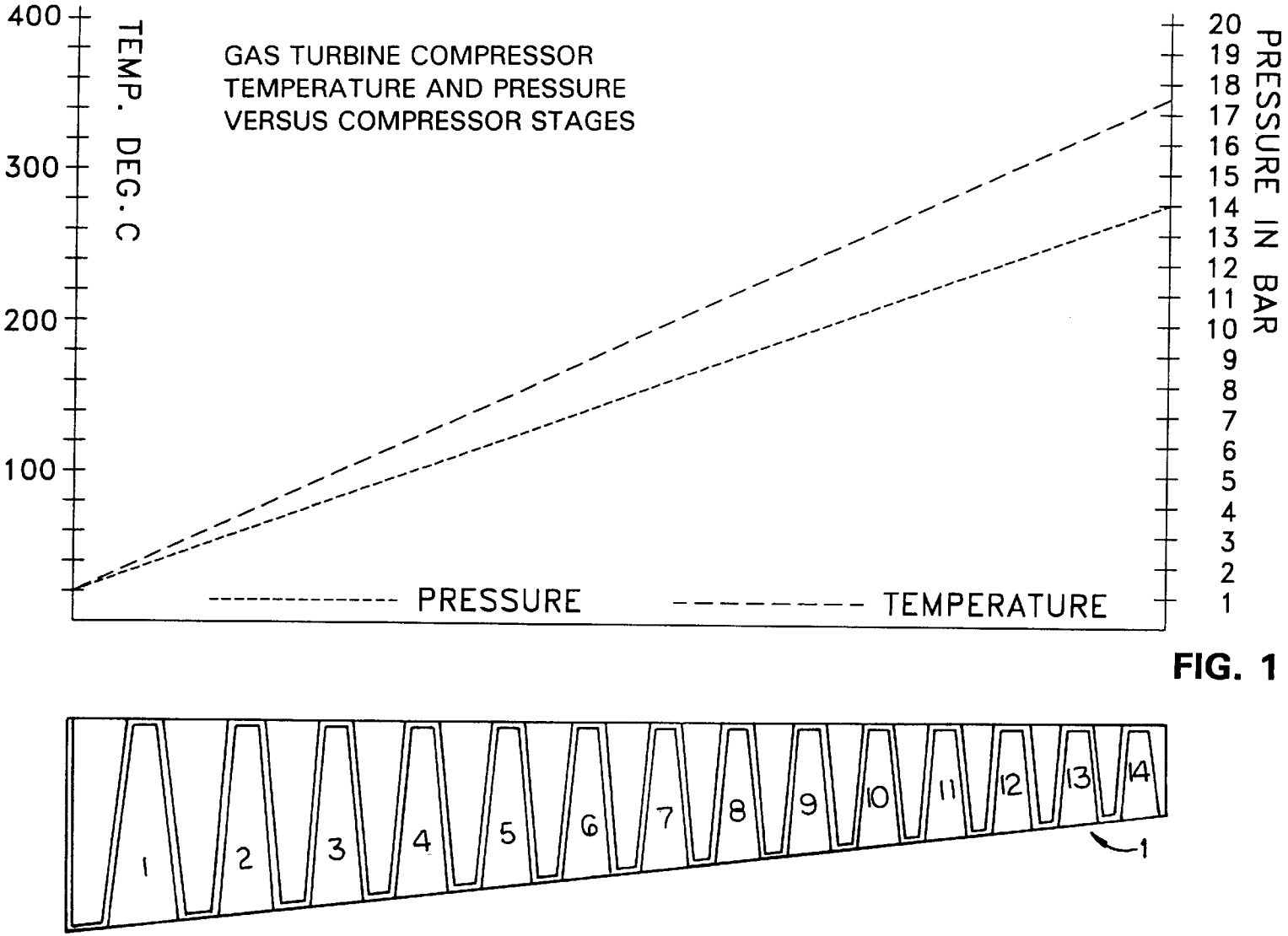
FIG. 1 is a graphical representation of temperature and pressure at different stages of a compressor.

FIG. 1 shows plots of temperature and pressure at different points of a typical fourteen stage compressor. Both increase significantly as air or fluid passes through the compressor. The fourteen stages of the compressor form the x-axis, with temperature and pressure being plotted on the y-axis.

Figure 2:
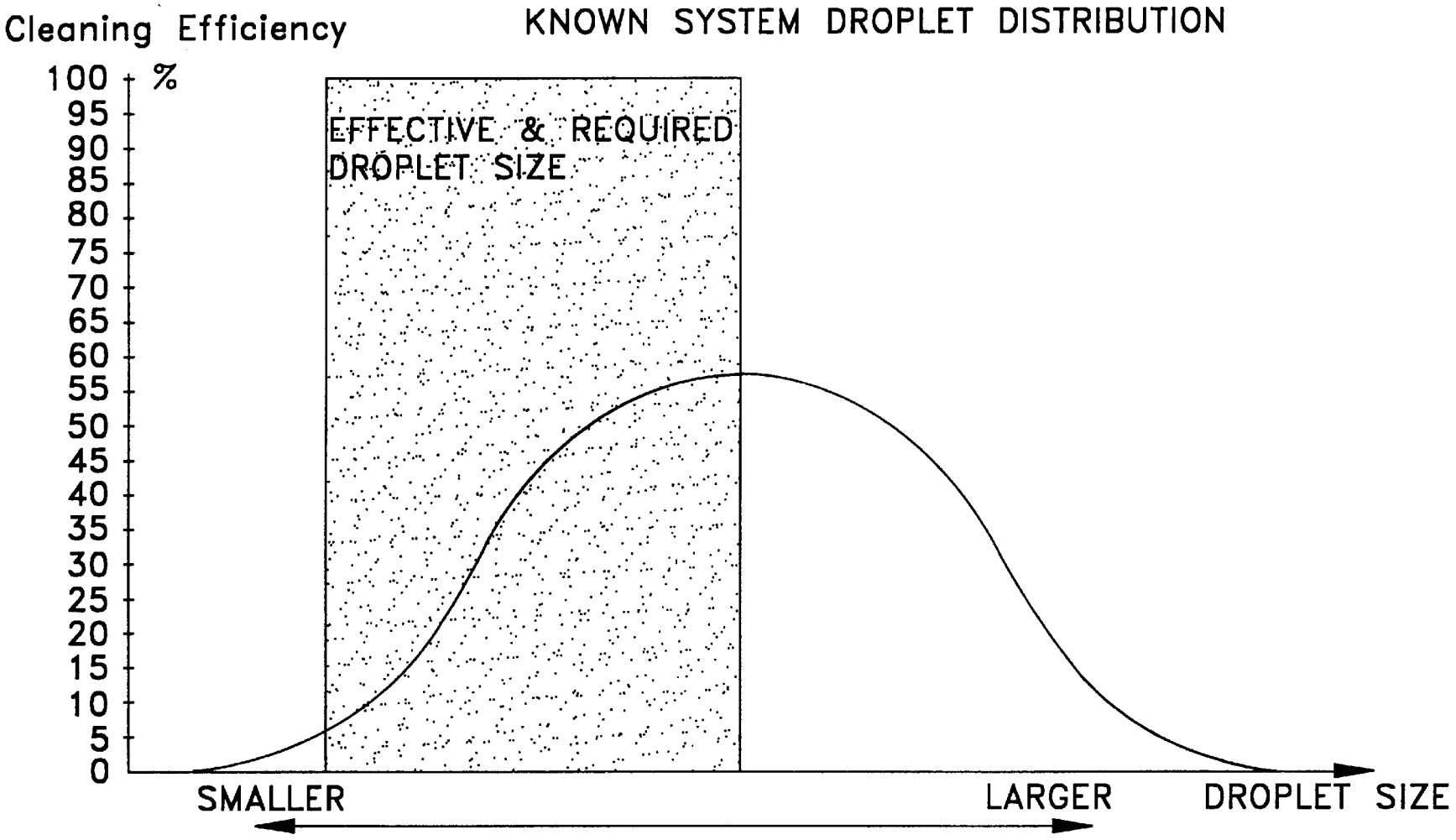
FIGS. 2 and 3 are graphs illustrating the cleaning efficiency of known cleaning methods.

FIG. 2 is a graph illustrating the cleaning efficiency of the known cleaning system without the predetermination and selection of an optimum droplet size. The lack of optimisation means that the cleaning section of the droplets is not optimal (about 55% at least) for any portion of the device being cleaned.

The droplet size curve shows the distribution of droplet size, and the shaded area under the droplet size curve represents the cleaning efficiency. The total area under the droplet size curve represents the total cleaning fluid flowing through the device being cleaned, and the shaded area under the curve represents the proportion of the cleaning fluid which impacts on the dirty surfaces and has a cleaning action. In the shown system, about half the fluid has no cleaning effect and is wasted.

Figure 3:
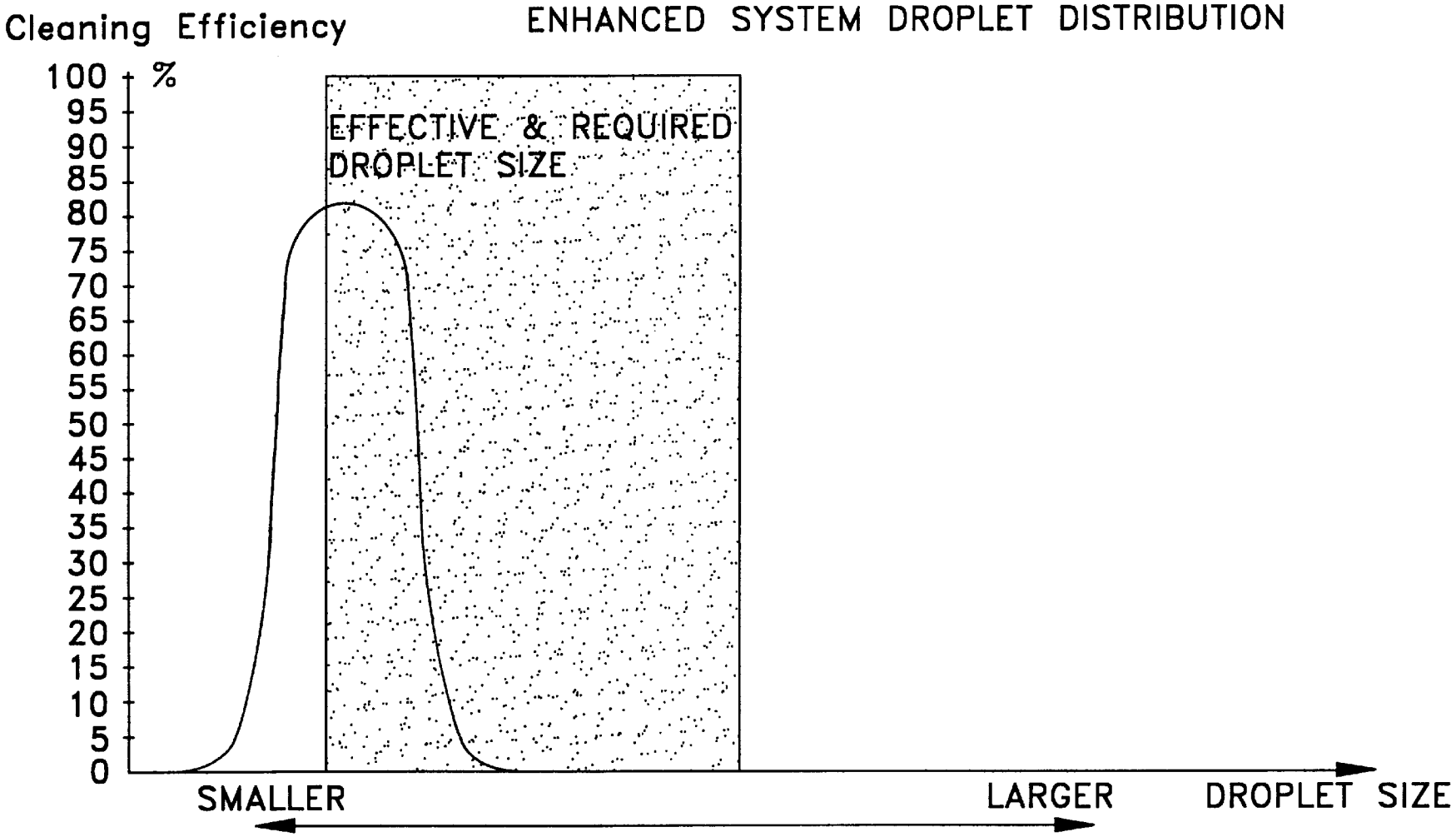

FIG. 3 is a similar graph to that of FIG. 2 but illustrates the cleaning effectiveness of the enhanced system with the predetermination and use of a single optimum droplet size.

As can be seen from FIG. 3, the droplet size has an 80% cleaning efficiency for the front of the compressor, and slightly less than half of the cleaning fluid is wasted. However, as discussed above and illustrated in the graph, the latter stages of the compressor are not cleaned.

Figure 4:
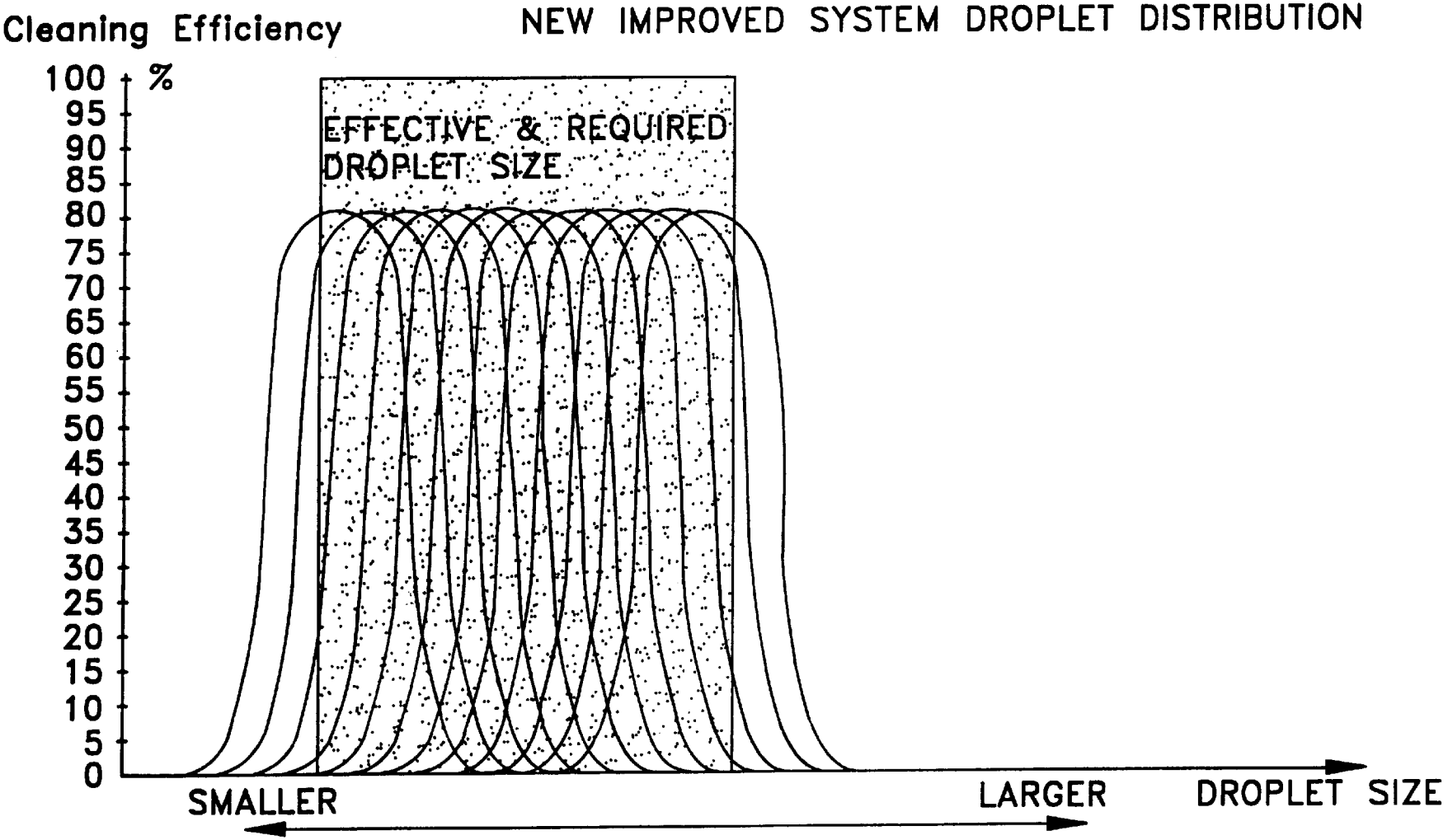
FIG. 4 is a graph illustrating the cleaning efficiency of the cleaning method of the present invention.

FIG. 4, is a graph illustrating the cleaning efficiency of the present invention. As shown in FIG. 4, using a sequence of different droplet sizes means that the compressor is efficiently cleaned along its length.

Figure 5:
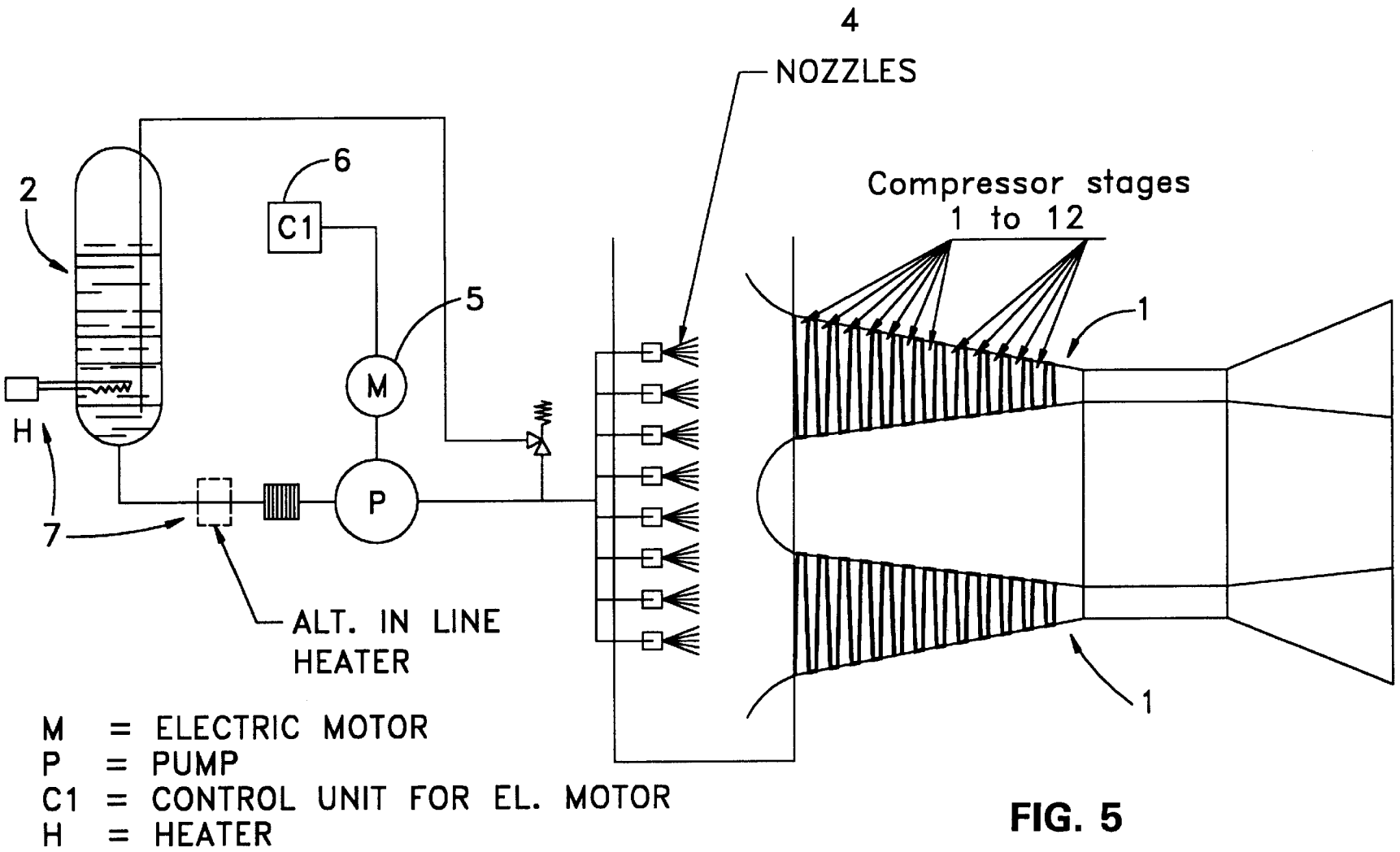
FIGS. 5 to 8 are diagrammatic illustrations of alternative embodiments of the present invention.

The system shown in FIG. 5 will generate droplets of a specific size at any given time. A reservoir 2 for cleaning fluid is connected via a pump 3 to spray nozzles 4 which are arranged to spray fluid pumped from the reservoir 2 into a compressor 1. The reservoir and line connecting the reservoir and pump have heater units 7 for heating the cleaning fluid. Adjustment of fluid temperature can also be used to control fluid pressure and droplet size.

The pump 3 is driven by a motor 5 which has an associated control unit 6. The pump, motor and control unit together form a motorised pressure regulator. The size of droplets sprayed from the nozzles 4 is determined by the fluid injection pressure which can be adjusted by the motorised pressure regulator. The regulator is controlled so that at the start of the cleaning process small droplets are produced that will effective on the first stage of the compressor. As the cleaning programme continues the droplet size will be gradually increased by the pressure regulator so that at the end of the programme the correct size of droplets required to clean the final stage of the compressor are being generated.

The variety of droplets size required for any particular compressor will vary from type to type and will also depend on the cleaning fluid used but will be in the range of 50–500 microns.

The optimum cycle of droplet sizes depends on the air flow through the compressor, the number of compressor stages as well as the temperature and pressure conditions at the input of, output of and at different points within, the compressor. Each gas turbine (or type of gas turbine) will have a specific set of optimum cleaning parameters governed by the specific operating parameters of the gas turbine.

The optimum cleaning cycle is determined as follows:

1] determine the number and type of spray nozzles required by evaluating the spray angle and flow rates required for effective cleaning. The droplet size is considered during this evaluation and a size of 150 microns at 70 bar pressure from the pump may be used for calibration purposes.

The spray angle is determined by considering the distance between the proposed location of the spray ring and the first stage of the compressor. Sufficient nozzles to give a 360° coverage of the first stage blading are required.

The desired flow rate is calculated by considering the total volume of fluid required for a wash duration of four to five minutes. It has been found that a wash duration of at least about four to five minutes is necessary to ensure adequate wetting of the surfaces to be cleaned. The volume of fluid required for each gas turbine type or model is a function of its output and is calculated from its output measured in MW.

2] Study the pressure and temperature gradients of the compressor and identify the stage at which water evaporates;

3] Having identified the point at which water evaporates, the sections prior to this can be treated with small droplets (eg, 80–100 microns). This can be achieved by increasing the pressure from the pump to about 100 bar.

The portion of the compressor located after the point of water evaporation would then be treated with slightly larger droplets, say 150 microns with a pump exit pressure of 70 bar.

4] The droplet size for cleaning the later stages of a compressor where there are greater local temperatures and pressures is affected by the length of the sections in the later stages and by the total length of the compressor. The droplet size for these later stages would typically be manipulated to between 200 and 500 microns by altering the pump out pressure to between 20 and 40 bar.

Figure 6:
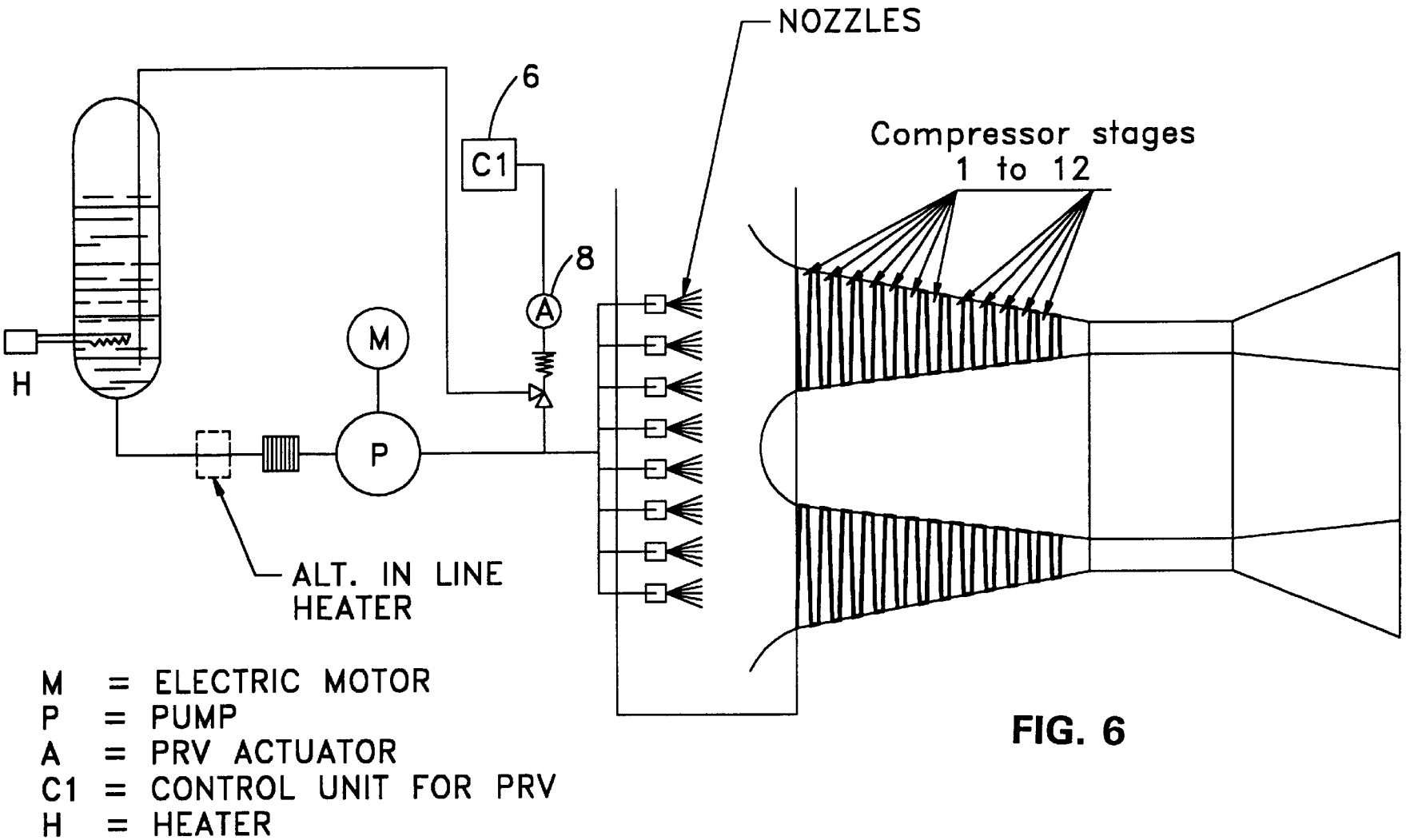
Figure 7:
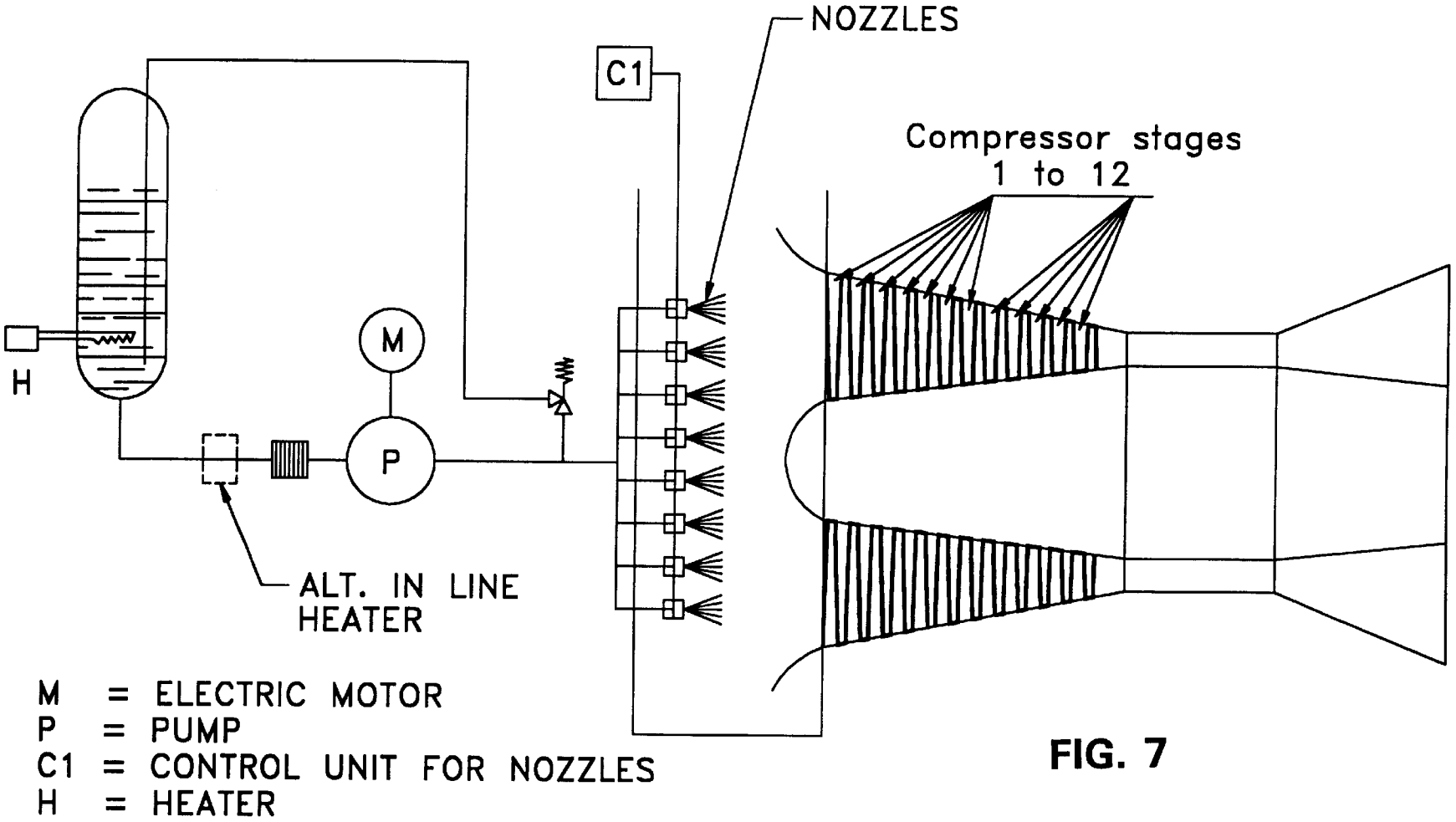

FIGS. 6 and 7 show different methods by which droplet size could be controlled.

FIG. 6 shows a system in which droplet size is controlled using a pressure regulator. The pump 3 produces fluid of a constant out pressure which is controllably regulated by an electronic pressure regulator comprising a PRU actuator and under the control of a control unit 6.

FIG. 7 shows a system in which droplet size is controlled using a variable or multiple size orifice nozzle.

Figure 8:
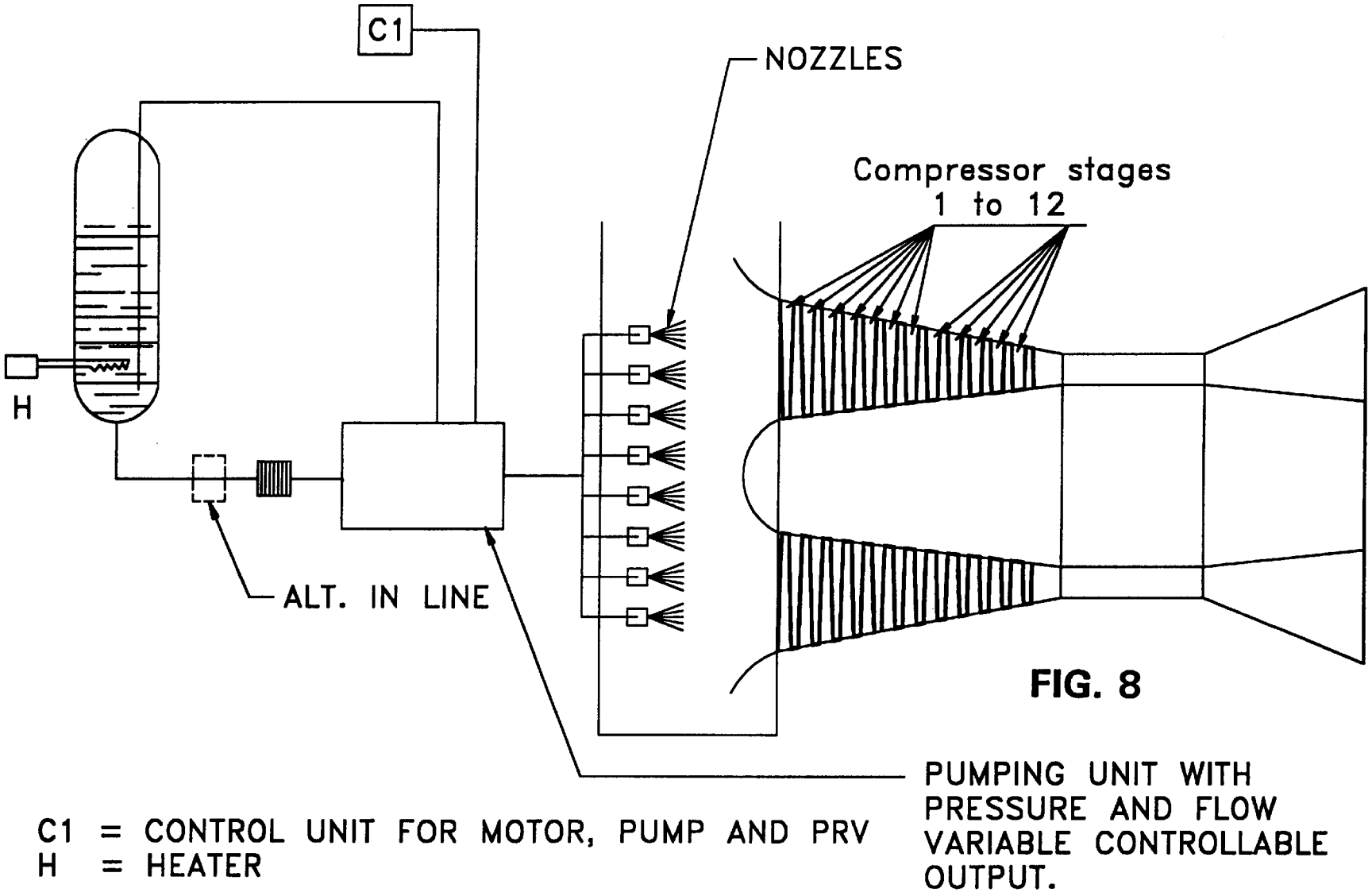

FIG. 8 shows a system in which the droplet side is controlled using a pumping unit with pressure and flow variable controllable output.

In an alternative embodiment, ultrasound waves applied to fluid as it passes through a nozzle can be used to control droplet size.

It is possible to achieve control over droplet size by applying the output of the pump 3, to a series of nozzles 4 having different atomising characteristics or to nozzles having a variable orifice.

The technology of the method and apparatus described above could be applied to the internal cleaning of axial and rotary air/gas compressors, the gas paths of internal combustion engines and any rotating devices used in the movement of air and gases.

The present invention could be applied to clean, for example, the compressor of an LM 1600 gas turbine.

The LM 1600 General Electric aero derivative gas turbine is a modern gas turbine described by many as having a difficult compressor to clean. This particular gas turbine is designed with a two stage compressor: a low pressure compressor and a high pressure compressor. The low pressure compressor is a 3-stage axial compressor and the high pressure compressor is a 7-stage axial compressor. The pressure ratio for the compressor is 20:1 and the air flow through the compressor is about 0.46 kg/s and the outlet temperature is 500° C. A distance between the low and high pressure compressor of about 25 cm has to be considered. Air speed at the inlet of the compressor is between 180–200 m/s. At the outlet of the compressor the air speed is approximately 220–230 m/s.

Figure 9:
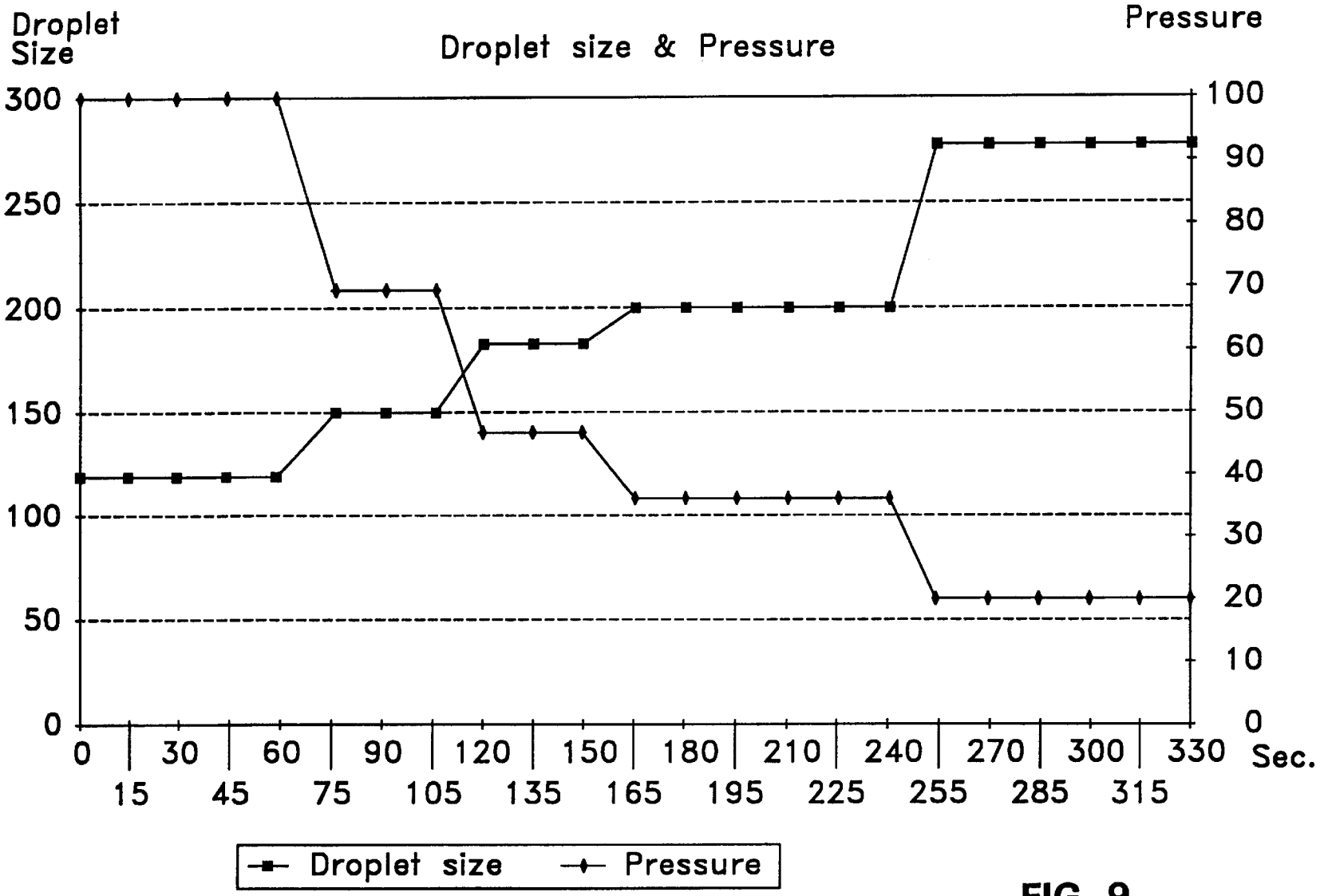
FIG. 9 is a graph illustrating optimum operating parameters for an embodiment of the cleaning method of the present invention using the apparatus of FIG. 5 to clean a LM 1600 General Electric aero derivative gas turbine.

The wash is performed in steps as described previously in order to get the correct droplet size for all the steps in the compressor. FIG. 9 shows the variation in cleaning fluid pressure and corresponding cleaning time (as well as the resulting inlet droplet size)as the compressor is cleaned.

The first step will cover the first 2 stages in the low pressure compressor. This step should last for 60 seconds and injection pressure must be kept between 90–100 bar in order to reach a droplet speed of approximately 120 m/s and droplet size of 120 $\mu$m.

The next step is for the last stage of the low pressure compressor and should last for 45 seconds. The pressure must be reduced to 60–70 bar in order to get droplets of approximately 150 $\mu$m. The high pressure compressor will require a 3 step sequence.

The third step is for the fourth stage (first stage of the high pressure compressor) and it should last for 45 seconds and pressure should be reduced to approximately 45 bar to produce droplets of 180 $\mu$m. Between stages four and five the temperature and pressure conditions will result in evaporation of the water in the wash fluid and the duration of the steps must therefore be extended. Step four will cover stages five, six and seven. The duration of this step is 90 seconds and the pressure is reduced to 30–35 bar. The last step will cover stages eight, nine and ten, also with a duration of 90 sec. With a pressure of 20 bar, the droplet speed for the last step is down to approximately 55 m/s. which is still higher than the airspeed in front of the compressor bellmouth.

What is claimed is:

1. A method of cleaning objects defining a path for the flow of fluid, wherein droplets of a cleaning fluid are sprayed into or onto the fluid path, comprising the steps of:

spraying droplets of a substantially first uniform size into or onto the fluid path for a first period;

and then spraying droplets of a substantially second uniform size into or onto the fluid path for a second period, wherein the first and second uniform droplet sizes are different.

2. A method according to claim 1 comprising at least one further spraying step in which droplets of a substantially further uniform size are sprayed into or onto the fluid path for a further pre-determined period, and wherein the uniform droplet size or sizes associated with the or each further spraying step are different from the first and second uniform droplet sizes, and where there are more than one further spraying steps, different from the droplet sizes of the other further spraying steps.

3. A method of cleaning a gas turbine compressor according to claim 1, wherein the first uniform droplet size is in the range 80 to 120 microns, and the second uniform droplet size is in the range 130 to 170 microns.

4. A method of cleaning the blades and/or rotor of a gas turbine compressor according to claim 1.

5. Apparatus for cleaning objects defining a path for the flow of fluid, including cleaning fluid spraying means for spraying droplets of a cleaning fluid into or onto the fluid path, and fluid spraying control means for controlling the size of droplets sprayed into or onto the fluid path such that droplets of a substantially first uniform size are sprayed for a first pre-determined period, and then droplets of a substantially different uniform size are sprayed for a second period.

* * * * *